US006091437A

United States Patent [19]

Yoneda et al.

[11] Patent Number: 6,091,437

[45] Date of Patent: Jul. 18, 2000

[54] THERMAL RECORDING SYSTEM INCLUDING THERMAL HEAD AND THERMAL RECORDING MATERIAL

[75] Inventors: Junichi Yoneda; Makoto Kashiwaya, both of Kanagawa, Japan

[73] Assignee: Fuji Photo Film Co., Ltd., Kanagawa, Japan

[21] Appl. No.: 08/958,446

[22] Filed: Oct. 27, 1997

[30] Foreign Application Priority Data

Oct. 25, 1996 [JP] Japan ..... 8-284488

[51] Int. Cl.[7] ..... B41J 2/335; B41J 2/32

[52] U.S. Cl. ..... 347/203; 347/171; 347/221

[58] Field of Search ..... 347/203, 171, 347/221; 503/227

[56] References Cited

U.S. PATENT DOCUMENTS

| | | | |
|---|---|---|---|
| 3,491,111 | 1/1970 | Lin | 260/315 |
| 3,624,107 | 11/1971 | Lin | 260/343.3 |
| 3,775,424 | 11/1973 | Farber | 260/295 |
| 5,250,346 | 10/1993 | Nagai et al. | 428/195 |
| 5,401,568 | 3/1995 | Hahn et al. | 428/323 |

FOREIGN PATENT DOCUMENTS

| | | | |
|---|---|---|---|
| 0 335 660 | 10/1989 | European Pat. Off. | H01L 23/14 |
| 40 16 935 | 11/1991 | Germany | B41J 2/335 |
| 61-189958 | 8/1986 | Japan | B41J 3/20 |
| 61-291183 | 12/1986 | Japan | B41M 5/18 |
| 62-146678 | 6/1987 | Japan | B41M 5/18 |
| 62-227763 | 10/1987 | Japan | B41J 3/20 |
| 63-72559 | 4/1988 | Japan | B41J 3/20 |
| 63-94878 | 4/1988 | Japan | B41M 5/12 |
| 63-216762 | 9/1988 | Japan | B41J 3/20 |
| 63-318546 | 12/1988 | Japan | G03C 1/52 |
| 2-136286 | 5/1990 | Japan | B41M 5/26 |
| 5-193171 | 8/1993 | Japan | B41J 2/335 |
| 5-305720 | 11/1993 | Japan | B41J 2/335 |
| 6-8501 | 1/1994 | Japan | B41J 2/335 |
| 6-31961 | 2/1994 | Japan | B41J 2/335 |
| 7-132628 | 5/1995 | Japan | B41J 2/335 |

OTHER PUBLICATIONS

Paper Pulp Technology Times, Sep. 1985, pp. 1–7.

Patent Abstracts of Japan vol. 095 No. 008, Sep. 29, 1995 & JP 07 132628 A (Toshiba Corp) May 23, 1995 *Abstract.

Patent Abstracts of Japan, vol. 014, No. 331 (M–0999) Jul. 17, 1990 & JP 02 112958 A (Matsushita Electric Ind Co., Ltd.) Apr. 25, 1990 *Abstract.

Patent Abstracts of Japan vol. 018, No. 264 (P–1740), May 19, 1994 & JP 06 036210 A (Alps Electric Co., Ltd.) Feb. 10, 1994 *Abstract.

*Primary Examiner*—Huan Tran

*Attorney, Agent, or Firm*—Sughrue, Mion, Zinn, Macpeak & Seas, PLLC

[57] ABSTRACT

The improved thermal recording system uses both a thermal head having a layer to protect heaters and a thermal recording material in which a thermal recording layer unit has a water content of no more than 6 wt. %, the protective layer of the thermal head comprising at least one ceramic-based lower sub-layer which is overlaid with a carbon-based upper sub-layer. This thermal recording system improves the wear resistance and electrical insulation of the protective layer on the thermal head so markedly that high operational reliability is insured for an extended period of time.

14 Claims, 3 Drawing Sheets

THERMAL RECORDING SYSTEM INCLUDING THERMAL HEAD AND THERMAL RECORDING MATERIAL

BACKGROUND OF THE INVENTION

This invention relates to the art of thermal recording using a thermal head, which is applicable to various types of printers, plotters, facsimile, recorders, etc.

Thermal materials comprising a thermal recording layer unit on a substrate of a film or the like are commonly used to record images produced in diagnosis by ultrasonic scanning.

This recording method, also referred to as thermal recording, eliminates the need for wet processing and offers several advantages including convenience in handling. Hence in recent years, the use of the thermal recording system is not limited to small-scale applications such as diagnosis by ultrasonic scanning and an extension to those areas of medical diagnoses such as CT, MRI and X-ray photography where large and high-quality images are required is under review.

As is well known, thermal recording involves the use of a thermal head having a glaze in which heating elements comprising heaters and electrodes, used for heating the thermal recording layer unit of a thermal material to record an image are arranged in one direction (main scanning direction) and, with the glaze urged at small pressure against the thermal material (thermal recording layer unit), the two members are moved relative to each other in the auxiliary scanning direction perpendicular to the main scanning direction, and the heaters of the respective pixels on the glaze are heated by energy application in accordance with image data to be recorded which were supplied from an image data supply source such as MRI in order to heat the thermal recording layer unit of the thermal material, thereby accomplishing image reproduction.

The glaze of the thermal head has a protective layer formed on the surface in order to protect the heaters for heating thermal materials, the associated electrodes and the like. It is this protective layer that contacts the thermal material during thermal recording and the heaters heat the thermal material through this protective layer so as to perform thermal recording.

The protective layer of the thermal head is usually made of wear-resistant ceramics; however, during thermal recording, the surface of the protective layer is heated and kept in sliding contact with the thermal material, so it will gradually wear and deteriorate upon repeated recording.

If the wear of the protective layer of the thermal head progresses, density nonuniformity or density variations will occur in the thermal image or the desired protective strength can not be maintained and, hence, the ability of the layer to protect the heaters is impaired to such an extent that the intended image recording is no longer possible (the head has lost its function). Particularly in the application such as the aforementioned medical use which requires variable-contrast images of high quality, the trend is toward ensuring the desired high image quality by adopting thermal films with highly rigid substrates such as polyester films and also increasing the settings of recording temperature (energy applied) and of the pressure at which the thermal head is urged against the thermal material.

Under these circumstances, as compared with the conventional thermal recording, a greater force (mechanical stress) and more heat are exerted on the protective layer of the thermal head, making wear and corrosion (or wear due to corrosion) more likely to progress. What is more, in thermal films using polyester films or like substrates, water and other substances in the thermal recording layer unit which will cause corrosion do not penetrate into the substrate but deposit on the surface, or the protective layer, of the thermal head; this tends to increase the concentrations of the corrosive substances in the surface of the protective layer, also resulting in accelerated corrosion.

With a view to preventing the wear of the protective layer on the thermal head so as to improve its durability, various methods have been proposed and commercialized on the basis of improvements in different aspects such as the protective layer per se, the thermal material and the recording conditions. Among these methods, the improvement of the thermal material is primarily based on the reduction of components that will cause wear and corrosion; however, this approach occasionally involves side effects such as head stain and sticking which make it difficult to achieve the intended anti-wear effect. The improvement of the recording conditions is based on the reduction of the maximum temperature that is employed by thermal recording, as well as the recording pressure; a problem with this approach is that the quality of the image being recorded is sometimes affected and the intended effectiveness is not attained in applications that require high image quality.

In order to prevent the wear of the protective layer on the thermal head, many techniques for improving its performance have heretofore been reviewed. To this end, attempts have been made to improve the protective layer and various proposals made. For example, SIALON (Si—Al—O—N) is known as a material suitable for use in the protective layer on the thermal head. According to Unexamined Published Japanese Patent Application (KOKAI) No. 193171/1993, a method is disclosed for improving the wear resistance of the protective layer on the thermal head by adjusting the relative proportions of the components of SIALON ($Si—Al_x—O_y—N_z$) to x=0.1–4.0, y=0.2–6.0 and z=1.2–3.0. Unexamined Published Japanese Patent Application (KOKAI) No. 216762/1988 discloses a method of preventing the delamination of the protective layer on the thermal head by adding a metal to SIALON; Unexamined Published Japanese Patent Application (KOKAI) No. 8501/1994 discloses a method of adjusting the hardness and electrical resistance of SIALON by addition of titanium nitride (TiN); and Unexamined Published Japanese Patent Application (KOKAI) No. 31961/1994 discloses a method of adjusting the thermal expansion of SIALON by addition of titanium boride (TiB)

Thin films of metal oxides such as chromium oxide (CrO) are also used as the protective layer of the thermal head and Unexamined Published Japanese Patent Application (KOKAI) No. 305720/1993 discloses a method in which the wear resistance of a protective layer made of chromium oxide is improved by addition of at least one oxide selected from the group consisting of silicon oxide, titanium oxide, aluminum oxide, cerium oxide and yttrium oxide or by addition of a nitride of a high-melting point metal (Cr or Ti).

According to these methods, the characteristics of the protective layer, particularly its wear resistance, are sufficiently improved to realize satisfactory thermal heads; however, under high-temperature, high-pressure recording conditions which are intended to record high-quality images, it is still impossible to provide sufficient wear resistance to ensure adequate reliability for the protective layer and various troubles including the functional failure of the head (breakage of heaters) and uneven uniformity in the recorded image will occur on account of the worn protective layer.

Other methods have been proposed to improve the wear resistance of the protective layer on the thermal head; for example, Unexamined Published Japanese Patent Application (KOKAI) No. 227763/1987 discloses the use of a thin diamond film as the protective layer, and Unexamined Published Japanese Patent Application (KOKAI) No. 72559/1988 discloses the use of a thin film solely made of or based on carbon and which has a thermal conductivity of at least 2.5 W/cm·deg as the protective layer. These methods are capable of forming protective layers that are very hard to feature high wear resistance; on the other hand, the protective layers thus formed have such a low electrical insulating property that on account of the static electricity generated by sliding contact with the thermal material, the heaters and the electrodes are prone to break.

Further, it has been proposed that the wear resistance of the protective layer on the thermal head be improved by composing it of more than one sub-layer so as to realize a thermal head having improved durability. For example, Unexamined Published Japanese Patent Application (KOKAI) No. 189958/1986 discloses a thermal head which has a protective layer comprising a first sub-layer made of a heat-resistant material having a volume resistivity of $10^3$–$10^{13}$ Ω·cm and an overlying second sub-layer made of superhard carbon, whereby not only the resistance of the protective layer to wear and environment is improved, but also high thermal efficiency is assured. In addition, Unexamined Published Japanese Patent Application (KOKAI) No. 132628/1995 discloses a thermal head which has a dual protective layer comprising a silicon-based compound sub-layer and an overlying diamond-like carbon sub-layer, whereby the potential wear and breakage of the protective layer are significantly reduced to ensure that high-quality image can be recorded over an extended period of time.

These dual protective layers have satisfactory wear resistance under mechanical stress but they often fail to exhibit high enough endurance against the wear caused by corrosive substances in the thermal recording material. According to the studies conducted by the present inventors, moisture has a particularly great influence on these protective layers and they do not prove fully effective in the process of thermal recording which is performed under high enough energy and pressure conditions to produce high-quality images.

SUMMARY OF THE INVENTION

The present invention has been accomplished under these circumstances and has as an object providing a thermal recording system which, even in the case of thermal recording performed under sufficiently high energy (high temperature) and pressure conditions to produce high-quality image, permits extremely small amounts of corrosion and wear in the protective layer on a thermal head and hence allows the thermal head to exhibit high reliability over an extended period of time, thereby ensuring that the thermal recording of high-quality image is performed consistently over an extended period of operation.

To attain the stated object, the invention provides a thermal recording system using both a thermal head having a layer to protect heaters and a thermal recording material in which a thermal recording layer unit has a water content of no more than 6 wt. %, said protective layer comprising at least one ceramic-based lower sub-layer which is overlaid with a carbon-based upper sub-layer.

It is preferred that the upper sub-layer of the protective layer is formed by physical evaporation or chemical vapor-phase growth of a carbon-based solid or gaseous film-forming material with the aid of a plasma generated in a vacuum chamber equipped with pump-down means.

It is also preferred that the upper sub-layer of the protective layer is a sputtered hard carbon film which is formed by sputtering of a sintered carbon or a glassy carbon as a target, or alternatively, a diamond-like hard carbon film which is formed by plasma-assisted chemical vapor deposit using a hydrocarbon gas as a reactive gas. The thickness of the upper sub-layer of the protective layer ranges preferably from 0.1 μm to 5 μm, more preferably from 1 μm to 3 μm. The upper sub-layer of the protective layer has preferably a multi-layer structure formed of either similar or dissimilar materials. The lower sub-layer of the protective layer is preferably formed of at least one material selected from the group consisting of silicon nitride, silicon carbide, tantalum oxide, aluminum oxide, SIALON, silicon oxide, aluminum nitride, boron nitride, selenium oxide and mixtures thereof. The lower sub-layer of the protective layer is preferably silicon-based. The thickness of the lower sub-layer of the protective layer ranges preferably from 2 μm to 20 μm, more preferably from 4 μm to 10 μm. The lower sub-layer of the protective layer has preferably a multi-layer structure formed of either similar or dissimilar materials. The thermal recording layer unit has preferably a water content of no more than 5 wt. %, more preferably no more than 4 wt. %.

DETAILED DESCRIPTION OF THE INVENTION

The thermal recording system of the invention will now be described in detail with reference to the preferred embodiments shown in the accompanying drawings.

Figure 1:
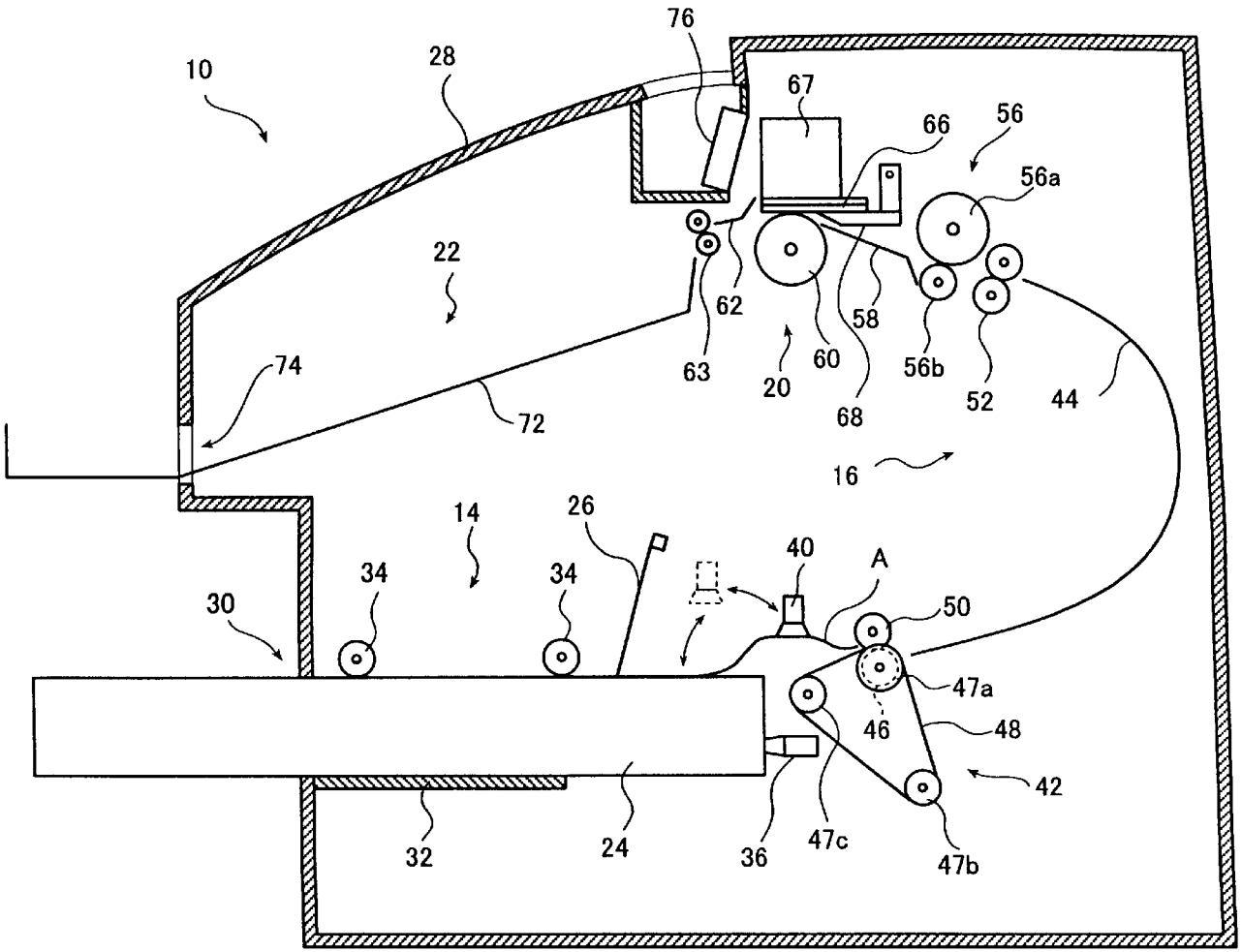
FIG. 1 shows the concept of an exemplary thermal recording apparatus using the thermal recording system of the invention.

FIG. 1 shows schematically an exemplary thermal recording apparatus using the thermal recording system of the invention.

The thermal recording apparatus generally indicated by 10 in FIG. 1 and which is hereunder simply referred to as a "recording apparatus 10" performs thermal recording on thermal recording materials of a given size, say, B4 (namely, thermal recording materials in the form of cut sheets, which are hereunder referred to as "thermal materials A"). The apparatus comprises a loading section 14 where a magazine 24 containing thermal materials A is loaded, a feed/transport section 16, a recording section 20 performing thermal recording on thermal materials A by means of the thermal head 66, and an ejecting section 22.

In the thus constructed recording apparatus 10, a thermal material A is taken out of the magazine 24 and transported to the recording section 20, where the thermal material A against which the thermal head 66 is pressed is transported in the auxiliary scanning direction perpendicular to the main scanning direction in which the glaze extends (normal to the papers of FIGS. 1 and 2) and in the meantime, the individual heaters are actuated in accordance with image data (on the image to be recorded) to perform thermal recording on the thermal material A.

The thermal material A comprises a substrate of a resin film such as a transparent polyethylene terephthalate (PET) film, a paper or the like which are overlaid with a thermal recording layer unit. The thermal material A to be used in the invention has a water content of no more than 6 wt. %, preferably no more than 5 wt. %, in the thermal recording layer unit (the coating layers other than the substrate which are on the side to be contacted by the thermal head 66).

The thermal material A to be used in the thermal recording system of the invention is not limited in any way other than in terms of the water content of the thermal recording layer unit and aside from this aspect, the thermal material A has essentially the same composition as known versions which are provided with a thermal recording layer unit having a thermal color forming layer such as the one which forms a color by allowing a color former to be brought into contact with a color developer upon heating, said color former and developer being isolated from each other at ordinary temperatures.

Specifically, all substrates that are used for known thermal materials can also be used with the thermal material A in the present invention and they include, for example, resin films typically made of polyesters (e.g., PET and polybutylene terephthalate), triacetyl cellulose, polyolefins (e.g., polypropylene and polyethylene) and polyvinylidene chloride, and paper. The thermal recording system of the invention also permits the use of thermal materials that use high-rigidity films as the substrate and yet the wear of the protective layer on the thermal head 66 can be reduced to an extremely low level.

The thickness of the substrate also is not limited to any particular value and it ranges generally from about 25 to 200 $\mu$m. The present invention is also applicable to transfer a thermal recording with advantage and, in this case, the donor sheet of a transfer thermal recording material has generally a thickness of at least 0.5 $\mu$m.

The thermal material A to be used in the invention may optionally have an anti-reflection layer on the back side of the thermal recording layer unit. The anti-reflection layer is not limited in any particular way and it may be selected from known anti-reflection layers which comprise binders (e.g., methyl cellulose, polyvinyl alcohol, acrylic resins and starches), and fine particulate substances such as fine particles obtained from cereals and fine particles of resins (e.g., polystyrene and polyurethane).

The color former and developer in the color forming layer which produces a color upon thermal recording are those components which are inherently substantially colorless but which, when heated, are brought into contact with each other to undergo a color forming reaction. The color former and developer in the thermal material A to be used in the invention are not limited to any particular types and various known combinations are applicable. To mention a few examples, the following combinations (A)–(L) may be employed:

(A) the combination of electron donating dye precursors and electron receptive compounds;

(B) the combination of photodegradable diazo compounds and couplers;

(C) combinations of organometal salts such as silver behenate and silver stearate with reducing agents such as protocatechuic acid and spiroindan;

(D) combinations of long-chain fatty acid salts such as ferric stearate and ferric myristate with phenols such as gallic acid and ammonium salicylate;

(E) combinations of organic acid heavy metal salts such as nickel acetate and copper stearate with alkaline earth metal sulfides such as potassium sulfide and strontium sulfide or organic chelatants such as s-diphenylcarbazide and diphenylcarbazone;

(F) combinations of (heavy) metal sulfides such as silver sulfide and lead sulfide with sulfur compounds such as Na-tetrathionate and sodium thiosulfate;

(G) combinations of aliphatic ferric salts such as ferric stearate and ferric pelargonate with aromatic polyhydroxy compounds such as 3,4-dihydroxytetraphenylmethane or carbamides such as thiocetylcarbamide and isothiocetylcarbamide;

(H) combinations of organic noble metal salts such as silver oxalate with organic polyhydroxy compounds such as glycerin and glycol;

(I) combinations of organic acid lead salts such as lead caproate and lead pelargonate with thiourea derivatives such as ethylenethiourea and N-dodecylthiourea;

(J) combinations of higher aliphatic acid (heavy) metal salts such as ferric stearate and copper stearate with dialkyldithiocarbamic acid zinc salts;

(K) combinations that form oxazine dyes, as exemplified by the combination of resorcinol and nitroso compounds; and (L) combinations of formazan compounds with reducing agents and/or metal salts.

Among the combinations listed above, (A) the combination of electron donating dye precursors and electron receptive compounds, (B) the combination of photodegradable diazo compounds and couplers and (C) the combination of organometal salts and reducing agents are preferred, and the combinations (A) and (B) are particularly preferred; the combination (A) is more particularly preferred from an image sharpness viewpoint.

The electron donating dye precursors (color former) in the combination (A) have the property of donating electrons or receiving protons as in acids to form a color and various known compounds which are used in thermal materials may be employed as long as they have such properties and are substantially colorless.

Specific examples include phthalide derivatives such as triphenylmethane phthalide derivatives and indolyl phthalide derivatives (see, for example, U.S. Pat. No. 3,491,111), fluoran derivatives (see, for example, U.S. Pat. No. 3,624,107), phenothiazine derivatives, leucoauramine derivatives, rhodamine lactam derivatives, triphenylmethane derivatives, triazenes, spiropyrans, fluorene derivatives (see, for example, Examined Japanese Patent Publication (KOHKOKU) No. 240989/1986), as well as pyridine derivatives and pyrazine derivatives (see, for example, U.S. Pat. No. 3,775,424).

Among these electron donating dye precursors, compounds represented by 2-arylamino-3-R-6-substituted aminofluoran (R is hydrogen, a halogen, an alkyl group or an alkoxy group) may be used with advantage, as specifically exemplified by 2-anilino-3-methyl-6-diethylaminofluoran, 2-anilino-3-methyl-6-N-cyclohexyl-N-methylaminofluoran and 2-p-chloroanilino-3-methyl-6-dibutylaminofluoran.

These electron donating dye precursors are combined with electron receptive compounds (color developer), which are exemplified by acidic substances such as phenols, organic acids or metal salts thereof and oxybenzoate esters.

Specific examples include: phenols such as p-phenylphenol and cumylphenol; bisphenols such as 2,2-bis(4'-hydroxyphenyl)propane, 2,2-bis(4'-hydroxyphenyl)pentane and 1,1-bis(4'-hydroxyphenyl)cyclohexane; salicylic acid derivatives such as 3,5-di-α-methylbenzylsalicylic acid and 3,5-tert-butylsalicylic acid or polyvalent metal (zinc or aluminum, inter alia) salts thereof; and oxybenzoate esters such as p-hydroxybenzoic acid benzyl ester and p-hydroxybenzoic acid 2-ethylhexyl ester; among these compounds, bisphenols are used with particular advantage for the various advantages they offer, such as improved color forming ability. The color developers under consideration are also disclosed in Unexamined Published Japanese Patent Application (KOKAI) No. 291183/1986.

These electron receptive compounds are preferably used in amounts of 50–800 wt. %, more preferably 100–500 wt. %, of the aforementioned electron donating dye precursors.

Referring to the combination (B), the photodegradable diazo compounds (color former) will react with the couplers (color developer) to produce the desired color and may be exemplified by aromatic diazonium salts, diazosulfonate compounds and diazoamino compounds. The aromatic diazonium compounds are represented by the following general formula: $ArN_2^+X^-$ (where Ar is an optionally substituted aromatic ring, $N_2^+$ is a diazonium group, and $X^+$ is an acid anion). The diazosulfonate compounds are obtained by treating various diazonium salts with sulfites. The diazoamino compounds are obtained by coupling the diazo group with dicyanodiamide, sarcocin, methyltaurine, etc. For further information on these photodegradable diazo compounds, reference should be had to Unexamined Published Japanese Patent Application (KOKAI) No. 136286/1990.

These photodegradable diazo compounds are combined with the couplers exemplified by 2-hydroxy-3-naphthoic acid anilide, resorcinol, as well as the compounds described in Unexamined Published Japanese Patent Application (KOKAI) No. 146678/1987.

If the combination (B) of photodegradable diazo compounds (color former) and couplers (color developer) is used in the thermal material A, basic substances such as organic ammonium salts, organic amines and thiazoles may be added in order to promote the coupling reaction.

In the thermal material A to be used in the invention, the above-described color formers and developers may be dispersed as solids in the color forming layer by known methods; however, from various viewpoints including improvement in the clarity of the color forming layer, the prevention of fogging due to the contact of the color former and developer at ordinary temperatures (i.e., improvement in keeping quality) and control over sensitivity for color formation, both the color former and developer are preferably dispersed as microcapsules in the color forming layer.

Various known methods of microcapsule formation may be employed, such as interfacial polymerization, internal polymerization and external polymerization. Particularly advantageous is interfacial polymerization, in which process a core substance containing a color former and a color developer is emulsified in an aqueous solution having a water-soluble substance such as gelatin or polyvinyl alcohol dissolved in water and, thereafter, polymer walls form around the oil droplets. Exemplary wall forming polymers include polyurethane, polyurea and polyamide.

If necessary, microcapsules having walls of different glass transition temperatures may be used in admixture in order to control the energy for color formation.

In a particularly preferred embodiment of the invention, the thermal material A is used with the color former being microencapsulated and the color developer emulsified as a dispersion in order to ensure that the color forming layer has a higher degree of clarity. Stated specifically, the color developer is dissolved in a slightly water-soluble or water-insoluble organic solvent and the resulting solution is mixed with an aqueous phase having a surfactant-containing water-soluble polymer as a protective colloid, thereby forming an emulsified dispersion of the color developer.

In order to form the color forming layer for use in the thermal material A, coating systems are prepared by dissolving or dispersing the above-described color formers and developers in water or organic solvents or like media, then applied and dried. Celluloses such as methyl cellulose, polyvinyl alcohol and modified resins thereof, (meth)acrylic resins, etc. may be added to the coating systems for the purpose of providing for uniform application of the coating systems and insuring the strength of the applied coating (color forming layer). Further, pigments, waxes, hardeners, etc. may be added as required.

The coating weights of the coating systems are not limited to any particular values and they are preferably applied in such amounts that the total amount of the color former and developer in the color forming layer ranges from 0.1 $g/m^2$ to 10 $g/m^2$ while the thickness of the color forming layer ranges from 1 μm to 20 μm.

The thermal material A to be used in the invention may be such that the aforementioned color forming layer and anti-reflection layer are formed directly on the surface of the substrate so that the thermal recording layer unit is solely composed of the color forming layer; alternatively, a subbing layer may be formed on the substrate in order to prevent the delamination of the color forming layer and the anti-reflection layer, then overlaid with the color forming layer and the anti-reflection layer.

Various clear resins may be used to form the subbing layer, as exemplified by acrylate ester copolymers, polyvinylidene chloride, styrene-butadiene (SBR) rubber and aqueous polyesters. The subbing layer is formed by applying a suitable coating system and drying the applied coating. The thickness of the subbing layer is not limited to any particular value and is preferably within a range from about 0.1 μm to about 0.5 μm.

When the subbing layer is overlaid with the color forming layer and other necessary layers, the water in the associated coating systems will swell the subbing layer to occasionally cause adverse effects on the quality of the image to be formed. To prevent this problem, hardeners such as glutaraldehyde, 2,3-dihydroxy-1,4-dioxane and boric acid are preferably added in amounts of about 0.2–3 wt. % to the subbing layer (i.e., its coating system).

The thermal material A to be used in the invention may also have a protective layer over the color forming layer in order to ensure that the apparent clarity will not be reduced by light scattering on the surface of the thermal recording layer unit. Thus, the thermal recording layer unit in the thermal material A to be used in the invention may solely be formed of the color forming layer or, alternatively, it may have a two- or three-layered structure consisting of the color forming layer, the subbing layer and/or the protective layer. In addition to these layers, the thermal recording layer unit may optionally include various other layers that perform such functions as matting or improving water resistance, strength, image quality, etc. and the thermal material A having such thermal recording layer unit is also applicable.

If desired, the thermal recording material may be of such a type that the thermal head will make contact with the side remote from the side where the color forming layer is formed.

All known types of protective layers conventionally used in the thermal material A are applicable in the invention and, from a clarity viewpoint, completely saponified polyvinyl alcohol, carboxy-modified polyvinyl alcohol and silica-modified polyvinyl alcohol are preferred. In addition, protective layers based on silicone resins are used with advantage since they improve not only clarity but also water resistance. Also useful are the protective layers described on pages 2–4 of "PAPER PULP TECHNOLOGY TIMES", September 1985 and in Unexamined Published Japanese Patent Application (KOKAI) No. 318546/1988.

The protective layer of the thermal material may also contain known additives such as hardeners, waxes and pigments.

The above-described color forming layer, subbing layer, protective layer, anti-reflection layer and other necessary layers can be formed by preparing respective coating systems, applying them and drying the applied coatings. Methods of application are not limited in any particular way and all known coating techniques including blade coating, air-knife coating, gravure coating, roll coating, dip coating and bar coating can be employed. Methods of drying the applied coatings are also not limited in any particular way and all known techniques including air-drying, oven drying, drying with warm (or hot) air and combinations of these methods are applicable.

As already noted, the thermal recording system of the invention is such that the thermal recording layer unit (i.e., the coating layers on the side to be contacted by the thermal head which consist of the color forming layer, subbing layer, protective layer and so forth) has a water content of no more than 6 wt. %. In order to meet this requirement, it is preferred that for each of the coating systems that form the respective layers, the drying conditions for forming them, as specifically exemplified by drying temperature, the temperature of warm (hot) air, drying time and drying environment (humidity and temperature), are adjusted to ensure that the thermal recording layer unit will have a water content of no more than 6 wt. %.

In addition to the thermal material A which is thus conditioned to have a water content of no more than 6 wt. % in the thermal recording layer unit, commercial thermal materials and the like may appropriately be processed to have the water content of the thermal recording layer unit adjusted to no more than 6 wt. % can also be used with advantage as thermal material A in the thermal recording system of the invention.

Methods for adjusting the water content of the thermal material A are not limited in any particular way and include various processing techniques, as exemplified by oven drying, drying with warm (or hot) air, drying with a dryer (or in a drying chamber), leaving in a humidity- and temperature-controlled atmosphere, and combinations of these methods.

In the thermal recording system of the invention, the thermal recording layer unit of thermal material A has preferably a water content of 5 wt. % or less, more preferably 4 wt. % or less. There is no lower limit for this water content and the lower the better.

Typically, such thermal materials A are stacked in a specified number, say, 100 to form a bundle, which is either wrapped in a bag or bound with a band to provide a package. As shown, the specified number of thermal materials A bundle together with the thermal recording layer side facing down are accommodated in the magazine 24 of the recording apparatus 10, and they are taken out of the magazine 24 one by one to be used for thermal recording.

The magazine 24 is a case having a cover 26 which can be freely opened. The magazine 24 which contains the thermal materials A is loaded in the loading section 14 of the recording apparatus 10.

The loading section 14 has an inlet 30 formed in the housing 28 of the recording apparatus 10, a guide plate 32, guide rolls 34 and a stop member 36; the magazine 24 is inserted into the recording apparatus 10 via the inlet 30 in such a way that the portion fitted with the cover 26 is coming first; thereafter, the magazine 24 as it is guided by the guide plate 32 and the guide rolls 34 is pushed until it contacts the stop member 36, whereupon it is loaded at a specified position in the recording apparatus 10.

The loading section 14 is equipped with a mechanism (not shown.) for opening or closing the cover 26 of the magazine.

The feed/transport section 16 has the sheet feeding mechanism using the sucker 40 for grabbing the thermal material A by application of suction, transport means 42, a transport guide 44 and a regulating roller pair 52 located in the outlet of the transport guide 44; thermal materials A are taken one by one out of the magazine 24 in the loading section 14 and transported to the recording section 20.

The transport means 42 comprises a transport roller 46, a pulley 47*a* coaxial with the roller 46, a pulley 47*b* coupled to a rotating drive source, a tension pulley 47*c*, an endless belt 48 stretched between the three pulleys 47*a*, 47*b* and 47*c*, and a nip roller 50 that pairs with the transport roller 46. The forward end of the thermal material A which has been sheet-fed by means of the sucker 40 is pinched between the transport roller 46 and the nip roller 50 such that the material A is transported.

When a signal for the start of recording is issued, the cover 26 is opened by the OPEN/CLOSE mechanism in the recording apparatus 10. Then, the sheet feeding mechanism using the sucker 40 picks up one sheet of thermal material A from the magazine 24 and feeds the forward end of the sheet to the transport means 42 (to the nip between rollers 46 and 50). At the point of time when the thermal material A has been pinched between the transport roller 46 and the nip roller 50, the sucker 40 releases the material, and the thus fed thermal material A is supplied by the transport means 42 into the regulating roller pair 52 as it is guided by the transport guide 44. At the point of time when the thermal material A to be used in recording has been completely ejected from the magazine 24, the OPEN/CLOSE mechanism closes the cover 26.

The distance between the transport means 42 and the regulating roller pair 52 which is defined by the transport guide 44 is set to be somewhat shorter than the length of the thermal material A in the direction of its transport. The forward end of the thermal material A first reaches the regulating roller pair 52 as the result of transport by the transport means 42. The regulating roller pair 52 are normally at rest. The forward end of the thermal material A stops here and is subjected to positioning.

When the forward end of the thermal material A reaches the regulating roller pair 52, the temperature of the thermal head 66 (the glaze) is checked and if it is at a specified level, the regulating roller pair 52 starts to transport the thermal material A, which is transported to the recording section 20.

The recording section 20 has the thermal head 66, a platen roller 60, a cleaning roller pair 56, a guide 58, a heat sink 67 for cooling the thermal head 66, a cooling fan 76 and a guide 62.

The thermal head 66 is capable of thermal recording at a recording (pixel) density of, say, about 300 dpi up to, for example, a maximum of B4 size. Except for the protective layer, the head has a known structure in that it has the glaze in which the heating elements performing thermal recording on the thermal material A are arranged in one direction, that is in the main scanning direction, and the cooling heat sink 67 is fixed to the thermal head 66. The thermal head 66 is supported on a support member 68 that can pivot about a fulcrum.

The thermal head 66 will be described in detail later.

It should also be noted that the thermal head 66 to be used in the thermal recording system of the invention is not particularly limited in such aspects as the width (in the main scanning direction), resolution (recording density) and recording contrast; preferably, the head width ranges from 5 cm to 50 cm, the resolution is at least 6 dots/mm (ca. 150 dpi), and the recording contrast consists of at least 256 levels.

The platen roller 60 rotates at a specified image recording speed while holding the thermal material A in a specified position, and transports the thermal material A in the auxiliary scanning direction perpendicular to the main scanning direction.

The cleaning roller pair 56 comprises an adhesive rubber roller 56*a* made of an elastic material and a non-adhesive roller 56*b*. The adhesive rubber roller 56*a* picks up dirt and other foreign matter that has been deposited on the thermal recording layer unit of the thermal material A, thereby preventing the dirt from being deposited on the glaze or otherwise adversely affecting the image recording operation.

Before the thermal material A is transported to the recording section 20, the support member 68 in the illustrated recording apparatus 10 has pivoted to UP position so that the thermal head 66 (or the glaze) is in the standby position just before coming into contact with the platen roller 60.

When the transport of the thermal material A by the regulating roller pair 52 starts, the material is subsequently pinched by the cleaning roller pair 56 and transported as it is guided by the guide 58. When the forward end of the thermal material A has reached the record START position (i.e., corresponding to the glaze), the support member 68 pivots and the thermal material A becomes pinched between the glaze on the thermal head 66 and the platen roller 60 such that the glaze is pressed onto the recording layer unit while the thermal material A is transported in the auxiliary scanning direction by means of the platen roller 60 (as well as the regulating roller pair 52 and the transport roller pair 63) as it is held in a specified position by the platen roller 60.

During this transport, the heaters of the respective pixels on the glaze are actuated imagewise to perform thermal recording on the thermal material A.

After the end of thermal recording, the thermal material A as it is guided by the guide 62 is transported by the platen roller 60 and the transport roller pair 63 to be ejected into a tray 72 in the ejecting section 22. The tray 72 projects exterior to the recording apparatus 10 via the outlet 74 formed in the housing 28 and the thermal material A carrying the recorded image is ejected via the outlet 74 for takeout by the operator.

Figure 2:
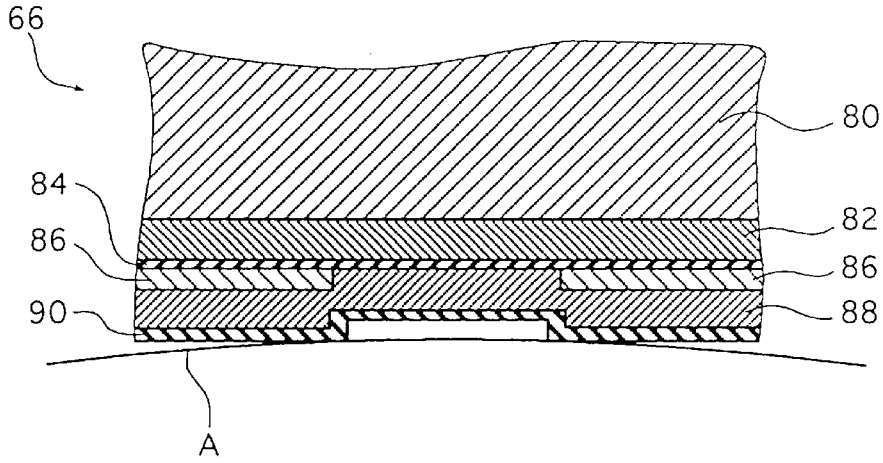
FIG. 2 is a schematic diagram showing the structure of a heating element in a thermal head used in the thermal recording system of the invention.

FIG. 2 is a schematic cross section of a heating element formed on the glaze of the thermal head 66. As shown, the too of a substrate 80 (which is shown to face down in FIG. 2 since the thermal head 66 is pressed downward against the thermal material A) is overlaid with a glaze layer 82 which, in turn, is overlaid with a (resistive) heater 84 which, in turn, is overlaid with electrodes 86 to form the heating element. The heating element is overlaid with a protective layer which protects the heater 84 and optionally the electrodes 86 and other parts.

As also shown in FIG. 2, the protective layer of the thermal head 66 for use in the thermal recording system of the invention is composed of at least two sub-layers, a ceramic-based lower sub-layer 88 and a carbon-based upper sub-layer 90.

Except for the layer arrangement of the protective layer, the thermal head 66 for use in the invention has essentially the same structure as known versions of thermal head. Therefore, the arrangement of other layers, the constituent materials of the glaze layer 82 and other components of the thermal head 66 are not limited in any particular way and various known versions may be employed. Specifically, the substrate 80 may be formed of various electrical insulating materials including heat-resistant glass and ceramics such as alumina, silica and magnesia; the glaze layer 82 may be formed of heat-resistant glass and the like; the heater 84 may be formed of heat-generating resistors such as Nichrome (Ni—Cr), tantalum metal and tantalum nitride; and the electrodes 86 may be formed of electrically conductive materials such as aluminum and copper.

Heating elements are known to be available in two types, one being of a thin-film type which is formed by a "thin-film" process such as vacuum evaporation, chemical vapor deposition (CVD) or sputtering and a photoetching technique, and the other being of a thick-film type which is formed by "thick-film" process comprising the steps of printing (e.g., screen printing) and firing and an etching technique. The thermal head 66 for use in the invention may be formed by either method.

The lower sub-layer 88 of the protective layer to be formed on the thermal head 66 for use in the invention may be formed of any known ceramic materials as long as they have sufficient heat resistance to serve as the protective layer of the thermal head. Specific examples include silicon nitride, silicon carbide, tantalum oxide, aluminum oxide, SIALON, silicon oxide, aluminum nitride, boron nitride, selenium oxide and mixtures thereof. Additives such as metals may be incorporated in small amounts for adjustment of physical properties.

Methods for forming the lower sub-layer 88 are not limited in any particular way and known methods of forming ceramic films (layers) may be employed by applying the aforementioned thick-film and thin-film processes and the like. If necessary, the lower sub-layer 88 may have a multi-layer structure formed of either similar or dissimilar materials.

The thickness of the lower sub-laver 88 is not limited to any particular value but it ranges preferably irom about 2 $\mu$m to about 20 $\mu$m, more preferably from about 4 $\mu$m about 10 $\mu$m. If the thickness of the lower sub-layer 88 is within the stated ranges, preferred results are obtained in various aspects such as the balance between wear resistance and heat conductivity (recording sensitivity).

To make the protective layer on the thermal head 66 for use in the invention, the lower sub-layer 88 is overlaid with the carbon-based upper sub-layer 90.

In the thermal recording system of the invention, the thermal head 66 having this protective layer composed of at least two sub-layers is used in combination with the thermal material A having no more than 6 wt. % of water in the thermal recording layer unit; as a result, the potential corrosion and wear of the protective layer on the thermal head 66 are sufficiently reduced to achieve a substantial improvement in the endurance of the thermal head 66 and the recording stability is also improved significantly, thereby ensuring high reliability over an extended period of time to provide for satisfactory thermal recording operations. If the water content of a thermal material is reduced, the chance for the generation of static electricity will increase; however, compared with ordinary ceramic materials, the upper protective sub-layer 90 has a sufficiently low electrical resistance to exhibit an antistatic effect.

Methods of forming the upper sub-layer 90 are not limited in any particular way and known thick- and thin-film processes may be employed. Preferred examples include the sputtering of a carbonaceous material (e.g., sintered carbon or glassy carbon) as a target to form a hard carbon film (i.e., a sputtered carbon film) and plasma-assisted CVD using a hydrocarbon gas as a reactive gas to form a hard carbon film (i.e., a diamond-like carbon film, or a DLC film).

Figure 3:
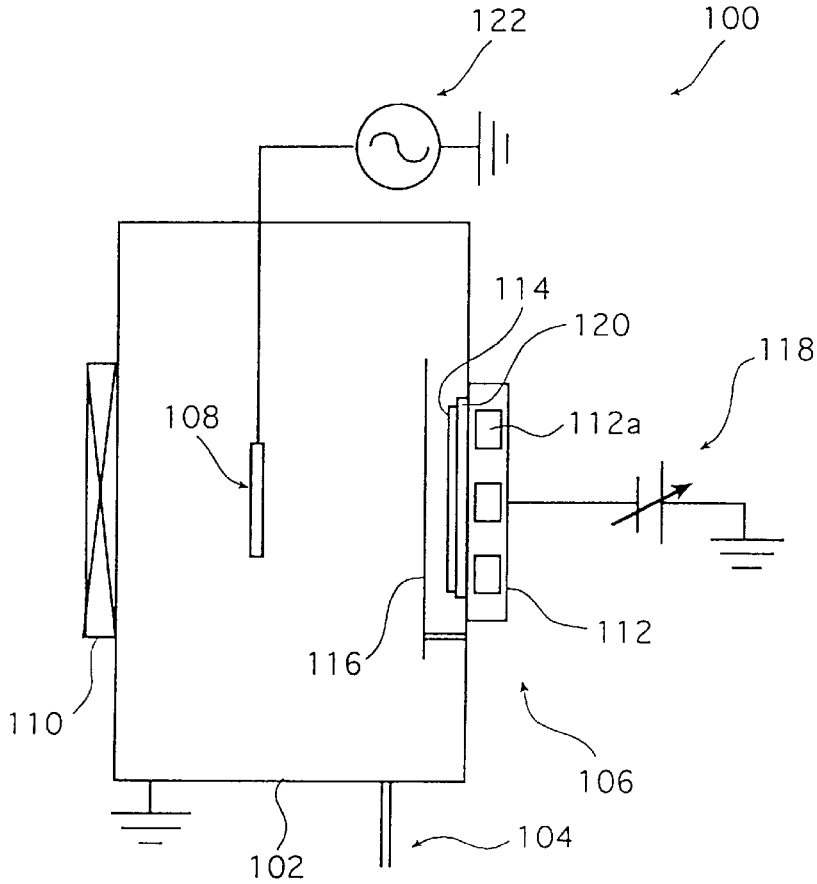
FIG. 3 shows the concept of an exemplary sputtering apparatus for forming the upper sub-layer of a protective layer on the thermal head to be used in the thermal recording system of the invention.

FIG. 3 shows the concept of a sputtering apparatus which forms a sputtered carbon film as the upper protective sub-layer 90. The sputtering apparatus generally indicated by 100 comprises a vacuum chamber 102, a gas introducing section 104, sputter means 106 and a substrate holder 108 as the basic components.

The vacuum chamber 102 is preferably formed of a nonmagnetic material such as SUS 304 in order to keep unperturbed the magnetic field generated by a cathode 112 to be described below. The vacuum chamber 102 which is used to form the upper sub-layer 90 of the protective layer on the thermal head 66 has preferably such a vacuum seal property that an ultimate pressure of $2\times10^{-5}$ Torr or below, preferably $5\times10^{-6}$ Torr or below, is reached by initial pump-down whereas an ultimate pressure between $1\times10^{4}$ Torr and $1\times10^{-2}$ Torr is reached during film deposition.

Pump-down means 110 is provided for the vacuum chamber 102 and a preferred example is the combination of a rotary pump, a mechanical booster pump and a turbomolecular pump; another preferred example is the replacement of the turbomolecular pump by a diffusion pump or a cryogenic pump. The performance and number of pump-down means 110 may be determined as appropriate for various factors including the capacity of the vacuum chamber 102 and the gas flows during film deposition. In order to increase the pumping speed, various adjustment designs may be employed, such as bypass pipes that provide for evacuation resistance adjustment and orifice valves which are adjustable in the degree of opening.

The gas introducing section 104 is a site where a plasma generating gas is introduced into the vacuum chamber 102 through a stainless steel pipe or the like that are vacuum sealed with an O-ring or the like at the inlet. The amount of the gas being introduced is controlled by known means such as a mass flow controller.

The gas introducing section 104 is basically so adapted as to displace the introduced gas to the neighborhood of the plasma-generating region in the vacuum chamber 102. The blowout position is preferably optimized to be such that the profile of the generated plasma will not be adversely affected.

Examples of the plasma generating gas for producing a sputtered carbon film are inert gases such as helium, neon, argon, krypton and xenon, among which argon gas is used with particular advantage because of its price and easy availability.

To effect sputtering, a target 114 to be sputtered is placed on the cathode 112, which is rendered at negative potential and a plasma is generated on the surface of the target 114, whereby atoms are struck out of the target 114 and deposit on the surface on the opposed substrate (i.e., the glaze of the thermal head 66) to form the sputtered carbon film.

The sputter means 106 comprises essentially the cathode 112, the area where the target 114 is to be placed, and a shutter 116.

In order to generate a plasma on the surface of the target 114, the negative side of a direct current (DC) power supply 118 is connected directly to the cathode 112, which is supplied with a DC voltage of 300–1,000 volts. The DC power supply 118 has an output of about 1–10 kW and a device having the necessary and sufficient output to produce the sputtered carbon film may appropriately be selected. The geometry of the cathode 112 may be determined as appropriate for various factors such as the geometry of the substrate on which the sputtered carbon film is to be formed. For anti-arc and other purposes, a DC power supply pulse-modulated for 2–20 kHz is also applicable with advantage.

Radio-frequency (RF) power supplies are also useful to generate plasmas. If an RF power supply is to be used, a high-frequency voltage is applied to the cathode 112 via a matching box so as to generate a plasma. The matching box performs impedance matching such that the reflected wave of the high-frequency voltage is no more than 25% of the incident wave. A suitable RF power supply may be selected from those in commercial use which produce outputs at 13.56 MHz having powers in the range of from about 1 kW to about 10 kW which are necessary and sufficient to produce the sputtered carbon film.

The target 114 may be secured directly to the cathode 112 with In-based solder or by mechanical means but usually a backing plate 120 made of oxygen-free copper, stainless steel or the like is first fixed to the cathode 112 and the target 114 is then attached to the backing plate 120 by the methods just described above. The cathode 112 and the backing plate 120 are adapted to be water-coolable so that the target 114 is indirectly cooled with water.

The target 114 used to form the sputtered carbon film is preferably made of sintered carbon, glassy carbon or the like. The geometry of the target 114 may be determined as appropriate for the geometry of the substrate.

Another method that can advantageously be employed to form the sputtered carbon film is magnetron sputtering, in which magnets 112*a* such as permanent magnets or electromagnets are placed within the cathode 112 and a sputtering plasma is confined within a magnetic field formed on the surface of the target 114. Magnetron sputtering is preferred since it achieves high deposition rates. The shape, position and number of the permanent magnets or electromagnets to be used and the strength of the magnetic field to be generated are determined as appropriate for various factors such as the thickness and its profile of the sputtered carbon film to be formed and the geometry of the target 114. Using permanent magnets such as Sm—Co and Nd—Fe—B magnets which are capable of producing intense magnetic fields is preferred for several reasons including the high efficiency of plasma confinement.

The substrate holder 108 fixes the thermal head 66 in position so that the substrate glaze is held in a predetermined face-to-face relationship with the cathode 112. If necessary, the glaze may be adapted to be rotatable or otherwise movable relative to the cathode 112 and a suitable design can be selected appropriately depending on several factors including the substrate size.

The distance between the substrate and the target 114 is not limited to any particular value and a distance that provides a uniform thickness profile for the sputtered carbon film may be set appropriately within the range from about 20 mm to about 200 mm.

When producing the thermal head 66 for use in the invention, the surface of the lower protective sub-layer 88 is preferably etched with a plasma prior to the formation of the sputtered carbon film in order to improve its adhesion to the lower sub-layer 88. To this end, the substrate holder 108 in the illustrated sputtering apparatus 100 is connected to a bias source 122 for applying a high-frequency voltage to the substrate via a matching box. A suitable bias source may be selected from among those in commercial use-which produce outputs at 13.56 MHz having powers in the range from about 1 kW to about 5 kW.

The intensity of etching may be determined with the bias voltage to the substrate being used as a guide; usually, an optimal value may be selected from the range of negative 100–500 volts.

Figure 4:
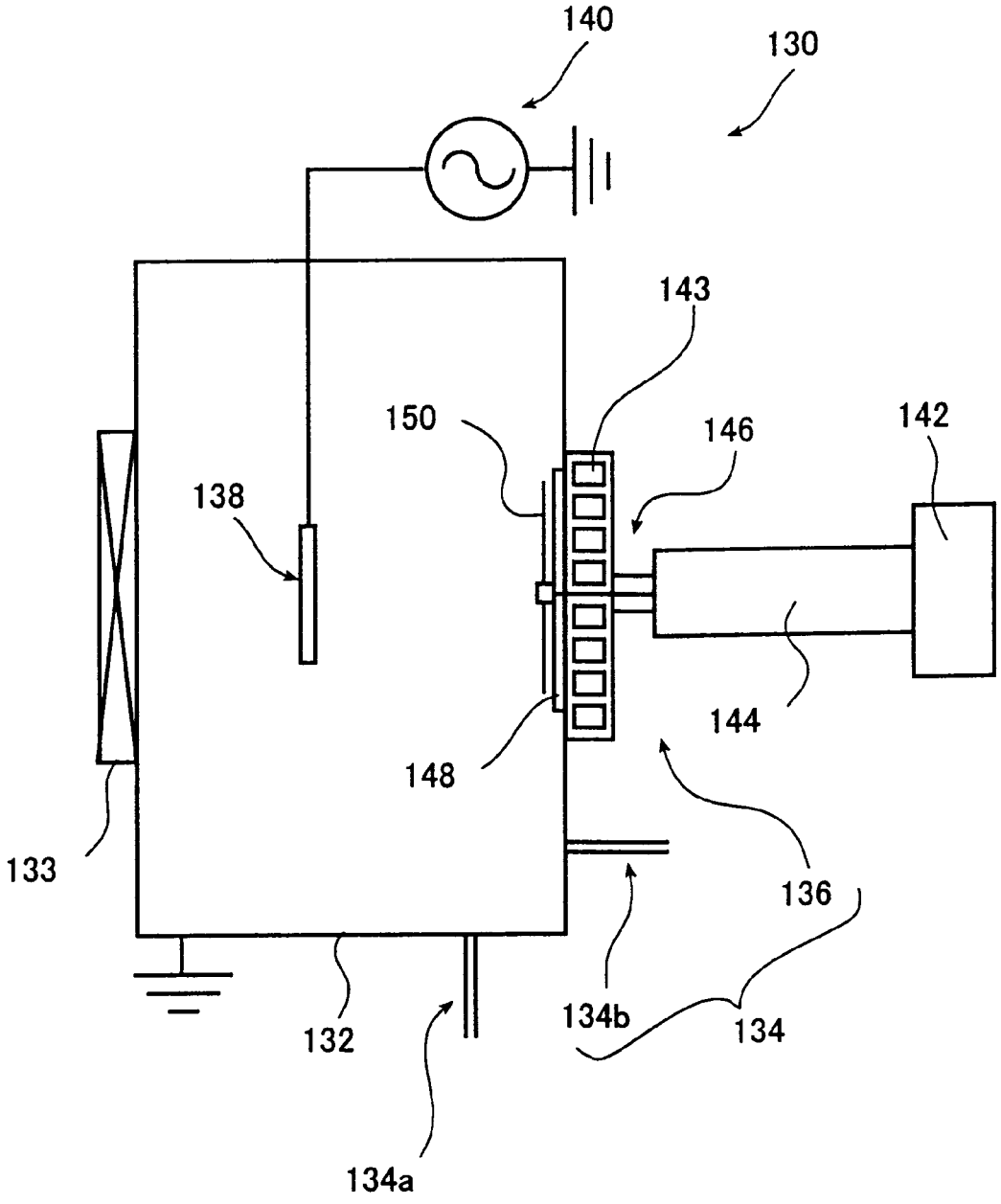
FIG. 4 shows the concept of a plasma-assisted CVD apparatus for forming the upper sub-layer of a protective layer on the thermal head to be used in the thermal recording system of the invention.

FIG. 4 shows the concept of a plasma-assisted CVD apparatus for forming a DLC film as the upper protective sub-layer 90. The CVD apparatus generally indicated by 130 comprises a vacuum chamber 132, a gas introducing section 134, plasma generating means 136, a substrate holder 138 and a substrate bias source 140 as the basic components.

The vacuum chamber 132 is preferably formed of a nonmagnetic material such as SUS 304 in order to keep unperturbed the magnetic field generated for plasma generation. The vacuum chamber 132 which is used to form the upper sub-layer 90 of the protective layer on the thermal head 66 has preferably such a vacuum seal property that an ultimate pressure of $2\times10^{-5}$ Torr or below, preferably $5\times10^{-6}$ Torr or below, is reached by initial pump-down whereas an ultimate pressure between $1\times10^{-4}$ Torr and $1\times10^{-2}$ Torr is reached during film deposition.

Pump-down means 133 is provided for the vacuum chamber 132 and a preferred example is the combination of a rotary pump, a mechanical booster pump and a turbomolecular pump; another preferred example is the replacement of the turbomolecular pump by a diffusion pump or a cryogenic pump. The performance and number of pump-down means 133 may be determined as appropriate for various factors including the capacity of the vacuum chamber 132 and the gas flows during film deposition. In order to increase the pumping speed, various adjustment designs may be employed, such as bypass pipes that provide for evacuation resistance adjustment and orifice valves which are adjustable in the degree of opening.

Those sites of the vacuum chamber 132 where plasma develops or an arc is produced by plasma generating electromagnetic waves may be covered with an insulating member, which may be made of insulating materials including MC nylon, Teflon (PTFE), polyphenylene sulfide (PPS), polyethylene naphthalate (PEN) and polyethylene terephthalate (PET). If PEN or PET is used, care must be taken to insure that the degree of vacuum will not decrease upon degassing of such insulating materials.

The gas introducing section 134 consists of two parts 134*a* and 134*b*, the former being a site for introducing a plasma generating gas and the latter for introducing a reactive gas, into the vacuum chamber 132 through stainless steel pipes or the like that are vacuum sealed with O-rings or the like at the inlet. The amounts of the gases being introduced are controlled by known means such as a mass flow controller.

Both gas introducing parts 134*a* and 134*b* are basically so adapted as to displace the introduced gases to the neighborhood of the plasma-generating region in the vacuum chamber 132. The blowout position, particularly that of the reactive gas introducing part 134*b*, has a certain effect on the thickness profile of the DLC film to be formed and, hence, it is preferably optimized in accordance with various factors such as the geometry of the substrate (the glaze of the thermal head 66).

Examples of the plasma generating gas for producing the DLC film are inert gases such as helium, neon, argon, krypton and xenon, among which argon gas is used with particular advantage because of price and easy availability. Examples of the reactive gas for producing the DLC film are the gases of hydrocarbon compounds such as methane, ethane, propane, ethylene, acetylene and benzene.

It is required with the gas introducing parts 134*a* and 134*b* that the sensors in the mass flow controllers be adjusted in accordance with the gases to be introduced.

In plasma-assisted CVD to form the DLC film (upper protective sub-layer 90), the plasma generating means may utilize various discharges such as DC discharge, RF discharge, DC arc discharge and microwave ECR discharge, among which DC arc discharge and microwave ECR discharge have high enough plasma densities to be particularly advantageous for high-speed film deposition.

The illustrated CVD apparatus 130 utilizes microwave ECR discharge and the plasma generating means 136 comprises basically a microwave source 142, magnets 143, a microwave guide 144, a coaxial transformer 146, a dielectric plate 148 and a radial antenna 150.

In DC discharge, a plasma is generated by applying a negative DC voltage between the substrate and the electrode. The DC power supply for use in DC discharge has an output of about 1–10 kW and a device having the necessary and sufficient output to produce the DLC film may appropriately be selected. For anti-arc and other purposes, a DC power supply pulse-modulated for 2–20 kHz is also applicable with advantage.

In RF discharge, a plasma is generated by applying a high-frequency voltage to the electrodes via a matching box, which performs impedance matching such that the reflected wave of the high-frequency voltage is no more than 25% of the incident wave. A suitable RF power supply for performing RF discharge may be selected from among those in commercial use which produce outputs at 13.56 MHz having powers in the range from about 1 kW to about 10 kW which are necessary and sufficient to produce the DLC film. A pulse-modulated RF power supply is also useful for RF discharge.

In DC arc discharge, a hot cathode is used to generate a plasma. The hot cathode may typically be formed of tungsten or lanthanum boride ($LaB_6$). DC arc discharge using a hollow cathode can also be utilized. A suitable DC power supply for use in DC arc discharge may be selected from those which produce outputs at about 10–150 A having powers in the range from about 1 kW to about 10 kW which are necessary and sufficient to produce the DLC film.

In microwave ECR discharge, a plasma is generated by the combination of microwaves and an ECR magnetic field and, as already mentioned, the illustrated CVD apparatus utilizes microwave ECR discharge for plasma generation. The microwave source 142 may appropriately be selected from those in commercial use which produce outputs at 2.45 GHz having powers in the range from about 1 kW to 3 kW which are necessary and sufficient to produce the DLC film.

To generate an ECR magnetic field, permanent magnets or electromagnets which are capable of forming the desired magnetic field may appropriately be employed and, in the illustrated case, Sm—Co magnets are used as the magnets 143. Consider, for example, the case of using microwaves at 2.45 GHz; since the ECR magnetic field has a strength of 875 G (gauss), the magnets 143 may be those which produce a magnetic field with intensities of 500–2,000 G in the plasma generating region.

Microwaves are introduced into the vacuum chamber 132 using the microwave guide 144, coaxial transformer 146, dielectric plate 148, etc. It should also be noted that the state of magnetic field formation and the microwave introducing path, both affecting the thickness profile of the DLC film to be deposited, are preferably optimized to provide a uniform thickness for the DLC film.

The substrate holder 138 fixes the thermal head 66 in position so that the substrate glaze is held in a predetermined face-to-face relationship with the radial antenna 150. If necessary, the glaze may be adapted to be rotatable or otherwise movable relative to the plasma generating means 136 and a suitable design can be selected appropriately depending on several factors including the substrate size.

The distance between the substrate and the radial antenna 150 is not limited to any particular value and a distance that provides a uniform thickness profile for the DLC film may be set appropriately within the range from about 20 mm to about 200 mm.

In order to form a hard film by plasma-assisted CVD, film deposition has to be performed with a negative bias voltage being applied to the substrate. The substrate bias source 140 is used to supply the required bias voltage.

A high-frequency self-bias voltage is preferably used as the bias source, being in the range of negative 100–500 volts. A suitable RF power supply may be selected from those in commercial use which produce outputs at 13.56 MHz having powers in the range from about 1 kW to about 5 kW. A DC power supply pulse-modulated for 2 kHz–20 kHz is also useful.

As in the case of using the sputtered carbon film as the upper protective sub-layer 90, the surface of the lower sub-layer 88 is preferably etched with a plasma prior to the formation of the DLC film in order to improve its adhesion to the lower sub-layer 88. The same etching method may be employed as in the case of forming the upper sub-layer 80 with the sputtering apparatus 100 and a high-frequency voltage is applied to the substrate via a matching box. A suitable RF power supply may be selected from those in commercial use which produce outputs at 13.56 MHz having powers in the range from about 1 kW to about 5 kW. The intensity of etching may be determined with the bias voltage to the substrate being used as a guide; usually, an optimal value may be selected from the range of negative 100–500 volts.

The thickness of the thus formed upper sub-layer 90 of the protective layer is not limited to any particular value but it ranges preferably from about 0.1 $\mu$m to about 5 $\mu$m, more preferably from about 1 $\mu$m to about 3 $\mu$m. If the thickness of the upper sub-layer 90 is within the stated ranges, preferred results are obtained in various aspects such as the balance between wear resistance and heat conductivity.

If necessary, the upper sub-layer 90 may have a multi-layer structure formed of either similar or dissimilar materials.

On the foregoing pages, the thermal recording system of the invention has been described in detail but the present invention is in no way limited to the stated embodiments and various improvements and modifications can of course be made without departing from the spirit and scope of the invention.

As described above in detail, the thermal recording system of the invention improves the wear resistance and electrical insulation of the protective layer on the thermal head so markedly that high operational reliability is insured for an extended period of time. Hence, according to the invention, there is realized a thermal recording apparatus that is very effectively protected against deterioration of the thermal head, thereby maintaining high reliability over an extended period of operation.

The following specific examples of the invention are provided to give a further illustration of it.

EXAMPLE 1

A sputtering apparatus 100 (see FIG. 3) was set up in the following manner.

a. Vacuum Chamber 102

This vacuum chamber was made of SUS 304 and had a capacity of 0.5 $m^3$; pump-down means 110 comprised one unit each of a rotary pump having a pumping speed of 1,500 L/min., a mechanical booster pump having a pumping speed of 12,000 L/min. and a turbomolecular pump having a pumping speed of 3,000 L/sec. An orifice valve was fitted at the suction inlet of the turbomolecular pump to allow for 10–100% adjustment of the degree of opening.

b. Gas Introducing Section 104

This gas introducing section was composed of a mass flow controller permitting a maximum flow of 100–500 sccm and a stainless steel pipe having a diameter of 6 mm. The joint between the stainless steel pipe and the vacuum chamber 102 was vacuum sealed with an O-ring.

Argon gas was used as a plasma generating gas in the following process of sputtered carbon film deposition.

c. Sputter Means 106

Sm—Co magnets were incorporated as permanent magnets 112*a*. The cathode 112 was in a rectangular form having a width of 600 mm and a height of 200 mm. The backing plate 120 was a rectangular sintered carbon member, which was attached to the cathode 112 with In-based solder. The interior of the cathode 112 was water-cooled to cool the magnets, the cathode 112 and the rear side of the backing plate 120.

The power supply 118 was of a DC type at negative potential capable of producing a maximal output of 8 kW. This DC power supply was adapted to be capable of pulse modulation at frequencies in the range of 2–10 kHz.

d. Substrate Holder 108

This substrate holder was so adapted that the distance between the substrate (i.e., the glaze of the thermal head 66) and the target 114 could be varied between 50 mm and 150 mm. In the following process of sputtered carbon film deposition, the distance between the substrate and the target 114 was set to be 100 mm.

That area of the substrate in which the thermal head was held was set at a floating potential in order to enable the application of an etching high-frequency voltage.

e. Bias Source 122

An RF power supply was connected to the substrate holder 108 via a matching box. The RF power supply had a frequency of 13.56 MHz and could produce a maximal output of 3 kW. It was also adapted to be such that by monitoring the self-bias voltage, the RF output could be adjusted over the range of negative 100–500 volts.

Fabrication of Thermal Head:

Using the sputtering apparatus 100 thus set up, a commercial thermal head (Model KGT-260-12MPH8 of KYOCERA CORP.) was revamped by forming a sputtered carbon film as an upper protective layer on the surface of the glaze in the following manner. The KYOCERA thermal head had a silicon nitride ($Si_3N_4$) film formed in a thickness of 11 $\mu$m as a protective layer on the surface of the glaze. Therefore, in Example 1, the silicon nitride film served as the lower protective layer, which was to be overlaid with a sputtered carbon film as the upper protective layer.

Thermal head 66 was secured to the substrate holder 108 in the vacuum chamber 102 such that the glaze would be in a face-to-face relationship with the target 114. All areas of the thermal head other than those where the upper protective layer was to be formed (namely, the non-glaze areas) were preliminarily masked. After the thermal head was fixed in position, the vacuum chamber 102 was pumped down to an internal pressure of $5\times10^{-6}$ Torr. With continued pump-down, argon gas was introduced through the gas introducing section 104 and the pressure in the vacuum chamber 102 was adjusted to $5.0\times10^{-3}$ Torr by means of the orifice valve fitted on the turbomolecular pump. Subsequently, a high-frequency voltage was applied to the substrate and the lower protective layer (silicon nitride film) was etched for 10 min. at a self-bias voltage of −300 volts.

After the end of etching, a sintered graphite member was fixed as the target 114 on the backing plate 120 (i.e., attached by means of In-based solder) and a DC power of 0.5 kW was applied to the target 114 for 5 min. with the shutter 116 being closed and the argon gas flow and the orifice valve so adjusted as to maintain the internal pressure at $5.0\times10^{-3}$ Torr.

Subsequently, with the internal pressure kept at the stated level, the DC power was raised to 5 kW, the shutter 116 opened and sputtering was performed until a sputtered carbon film deposited in a thickness of 1 μm, thereby fabricating a thermal head which had the sputtered carbon film formed as the upper protective layer in a thickness of 1 μm. The same procedure was repeated to fabricate two additional samples of thermal head having sputtered carbon films formed as the upper protective layer in respective thickness of 2 μm and 3 μm.

To control the thickness of the sputtered carbon film being formed, the deposition rate was determined preliminarily and the time required to reach a specified film thickness was calculated.

Preparing Thermal Material:

A commercial thermal material (CR-AT, dry image recording film manufactured by Fuji Photo Film Co., Ltd.) was left to stand in an atmosphere of 25° C.×45% r.h. for 5 h. The thermal recording layer unit of this thermal material was found to have a water content of 4% upon measurement with a micro-water analyzer AQ-5 of Hiranuma Sangyo Co., Ltd.

Evaluation of Performance:

Using the three samples of thermal head according to the present invention and the above-prepared thermal material, thermal recording was performed over an equivalent length of 500 m and the performance of each sample was evaluated by the following criteria: ○, the protective layer on the thermal head hardly wore; Δ, 0.2–0.5 μm wear occurred in the protective layer; X, wear of 0.5 μm or above occurred in the protective layer. All samples were rated ○.

Additional samples of thermal head were fabricated by forming sputtered carbon films (upper protective layers) in thickness of 1, 2 and 3 μm under the same conditions as described above, except for the following differences: no etching was done; the pressure in the vacuum chamber 102 during etching was changed to $8.0\times10^{-3}$ Torr; the self-bias voltage during etching was changed to −200 volts or −400 volts; or the pressure in the vacuum chamber 102 during film deposition was changed to $3.0\times10^{-3}$ Torr or $8.0\times10^{-3}$ Torr. These samples were subjected to the same test for performance evaluation and each rated ○.

EXAMPLE 2

A plasma-assisted CVD apparatus (see FIG. 4) was set up in the following manner.

a. Vacuum Chamber 132

The same as used in Example 1.

b. Gas Introducing Section 134

The same as used in Example 1, except that it was composed of two parts, one for introducing a plasma generating gas and the other for introducing a reactive gas.

Argon gas was used as a plasma generating gas in the following process of DLC film formation.

c. Plasma Generating Means 136

A microwave source 142 oscillating at a frequency of 2.45 GHz and producing a maximal output of 1.5 kW was employed. The generated microwave was guided to the neighborhood of the vacuum chamber 132 by means of a microwave guide 144, passed through a coaxial transformer 146 and directed to a radial antenna 150 in the vacuum chamber 132.

The plasma generating section was in a rectangular form having a width of 600 mm and a height of 200 mm.

A magnetic field for ECR was produced by a plurality of Sm—Co magnets arranged in a pattern to conform to the shape of the dielectric plate 148.

d. Substrate Holder 138

The same as in Example 1, except that the distance between the substrate and the radial antenna 150 was set to be 150 mm during the process of DLC film formation.

e. Substrate Biasing Means 140

An RF power supply was connected to the substrate holder 138 via a matching box. The RF power supply had a frequency of 13.56 MHz and could produce a maximal output of 3 kW. It was also adapted to be such that by monitoring the self-bias voltage, the RF output could be adjusted over the range of negative 100–500 volts.

In the CVD apparatus 130 under consideration, the substrate biasing means 140 also served as substrate etching means.

Fabrication of Thermal Head:

Using the CVD apparatus 130 thus set up, a commercial thermal head of the same model as used in Example 1 was revamped by forming a DLC film as an upper protective layer on the surface of the glaze in the following manner. Thus, as in Example 1, the silicon nitride film served as the lower protective layer, which was to be overlaid with a DLC film as the upper protective layer.

The thermal head was secured to the substrate holder 138 in the vacuum chamber 132 such that the glaze would be in a face-to-face relationship with the radial antenna 150. All areas of the thermal head other than those where the upper protective layer was to be formed (namely, the non-glaze areas) were preliminarily masked. After the thermal head was fixed in position, the vacuum chamber 132 was pumped down to an internal pressure of $5\times10^{-6}$ Torr.

With continued pump-down, methane gas was introduced through the gas introducing part 134*a* and the pressure in the vacuum chamber 132 was adjusted to $5.0\times10^{-3}$ Torr by means of the orifice valve fitted on the turbomolecular pump. Subsequently, the microwave source 142 was driven to supply microwaves into the vacuum chamber 132 so as to generate a microwave ECR plasma; further, a high-frequency voltage was applied to the substrate and the lower protective layer (silicon nitride film) was etched for 10 min. at a self-bias voltage of −300 volts.

After the end of etching, with the high-frequency voltage being kept applied to maintain the self-bias voltage at −300 volts, plasma-assisted CVD was performed by introducing methane gas to give a pressure of $5.0\times10^{-3}$ Torr within the vacuum chamber 132, thereby fabricating a thermal head which had a DLC film formed as the upper protective layer in a thickness of 1 μm. The same procedure was repeated to fabricate two additional samples of thermal head having DLC films formed as the upper protective layer in respective thickness of 2 μm and 3 μm.

To control the thickness of the DLC film being formed, the deposition rate was determined preliminarily and the time required to reach a specified film thickness was calculated.

Preparing Thermal Material:

The same as in Example 1.

Evaluation of Performance:

Using the thus-prepared thermal material, the performance of the three samples of thermal head according to the present invention was evaluated as in Example 1. All samples were rated ○.

Additional samples of thermal head were fabricated by forming DLC films (upper protective layers) in thickness of 1, 2 and 3 μm under the same conditions as described above, except for the following differences: no etching was done; the pressure in the vacuum chamber 132 during etching was changed to $0.8\times10^{-3}$ Torr or $1.0\times10^{-3}$ Torr; the self-bias voltage during etching was changed to −200 volts or −400 volts; the self-bias voltage during film deposition was changed to −200 volts or −400 volts; or the reactive gas flow during film deposition was adjusted to change the pressure in the vacuum chamber 132 to $2.0\times10^{-3}$ Torr or $3.0\times10^{-3}$ Torr. These samples were subjected to the same test for performance evaluation and each rated ○.

EXAMPLE 3

Thermal Head:

This was the sample of thermal head fabricated in Example 2 which had a DLC film formed as an upper protective layer in a thickness of 2 μm.

Preparing Thermal Material:

A commercial thermal material (transmission-type thermal film for use with FIT-1000, manufactured by Fuji Photo Film Co., Ltd.) was left to stand in an atmosphere of 25° C.×45% r.h. for 5 h. The thermal recording layer unit of this thermal material was found to have a water content of 3% upon measurement with a micro-water analyzer AQ-5 of Hiranuma Sangyo Co., Ltd.

Evaluation of Performance:

Using the thus-prepared thermal material, the performance of the thermal head was evaluated as in Example 1. The rating was ○.

Example 4

Thermal Head:

This was the sample of thermal head fabricated in Example 2 which had a DLC film formed as an upper protective layer in a thickness of 2 μm.

Preparing Thermal Material:

A commercial thermal material (F50US of Fuji Photo Film Co., Ltd.) was left to stand in an atmosphere of 25° C.×45% r.h. for 5 h. The thermal recording layer unit of this thermal material was found to have a water content of 5% upon measurement with a micro-water analyzer AQ-5 of Hiranuma Sangyo Co., Ltd.

Evaluation of Performance:

Using the thus-prepared thermal material, the performance of the thermal head was evaluated as in Example 1. The rating was ○.

Comparative Example 1

Thermal Head:

KYOCERA KGT-260-12MPH8 was used; it was the same as used in Examples 1–4, except that no upper protective layer was formed.

Thermal Material:

The same as used in Example 1.

Evaluation of Performance:

Using the thermal material just described above, the performance of KYOCERA KGT-260-12MPH8 was evaluated as in Example 1; the rating was x.

Comparative Example 2

Fabrication of Thermal Head:

KYOCERA KGT-260-12MPH8 (the same as used in Examples 1–4, except that no upper protective layer was formed) was revamped by forming a protective SiC coating as an upper protective film in a thickness of 2 μm with a sputtering apparatus of the same type as employed in Example 1 using a SiC sinter as a target.

Thermal Material:

The same as used in Example 1.

Evaluation of Performance:

Using the above-described thermal material, the performance of the revamped thermal head was evaluated as in Example 1. The rating was Δ.

Comparative Example 3

Thermal Head:

This was the sample of thermal head fabricated in Example 2 which had a DLC film formed as an upper protective layer in a thickness of 2 μm.

Preparing Thermal Material:

A commercial thermal material (CR-AT, dry image recording film manufactured by Fuji Photo Film Co., Ltd.) was left to stand in an atmosphere of 25° C.×70% r.h. for 5 h. The thermal recording layer unit of this thermal material was found to have a water content of 7% upon measurement with a micro-water analyzer AQ-5 of Hiranuma Sangyo Co., Ltd.

Evaluation of Performance:

Using the thus-prepared thermal material, the performance of the thermal head was evaluated as in Example 1. The rating was Δ.

Comparative Example 4

Thermal Head:

KYOCEPA KGT-260-12MPH8 (see Comparative Example 1) was used.

Thermal Material:

The same as used in Comparative Example 3.

Evaluation of Performance:

Using the above-described thermal material, the performance of the thermal head was evaluated as in Example 1. The rating was x.

These results clearly demonstrate the effectiveness of the present invention.

What is claimed is:

1. A thermal recording system using both a thermal head having a layer to protect heaters and a thermal recording material in which a thermal recording layer unit has a water content of no more than 6 wt. %, said protective layer of the thermal head comprising at least one ceramic-based lower sub-layer which is overlaid with a carbon-based upper sub-layer.

2. The thermal recording system according to claim 1, wherein said upper sub-layer of the protective layer of the thermal head is formed by one of physical evaporation and chemical vapor-phase growth of a carbon-based solid or gaseous film-forming material with the aid of a plasma generated in a vacuum chamber equipped with pump-down means.

3. The thermal recording system according to claim 2, wherein said upper sub-layer of the protective layer of the thermal head is a sputtered hard carbon film which is formed by sputtering of one of a sintered carbon and a glassy carbon as a target.

4. The thermal recording system according to claim 2, wherein said upper sub-layer of the protective layer of the thermal head is a diamond-like hard carbon film which is formed by plasma-assisted chemical vapor deposit using a hydrocarbon gas as a reactive gas.

5. The thermal recording system according to claim 1, wherein the thickness of said upper sub-layer of the protective layer of the thermal head ranges from 0.1 μm to 5 μm.

6. The thermal recording system according to claim 5, wherein the thickness of said upper sub-layer of the protective layer of the thermal head ranges from 1 μm to 3 μm.

7. The thermal recording system according claim 1, wherein said upper sub-layer of the protective layer of the thermal head has a multi-layer structure formed of either one of similar and dissimilar materials.

8. The thermal recording system according to claim 1, wherein said lower sub-layer of the protective layer of the thermal head is formed of at least one material selected from the group consisting of silicon nitride, silicon carbide, tantalum oxide, aluminum oxide, SIALON, silicon oxide, aluminum nitride, boron nitride, selenium oxide and mixtures thereof.

9. The thermal recording system according to claim 1, wherein said lower sub-layer of the protective layer of the thermal head is silicon-based.

10. The thermal recording system according to claim 1, wherein the thickness of said lower sub-layer of the protective layer of the thermal head ranges from 2 μm to 20 μm.

11. The thermal recording system according to claim 10, wherein the thickness of said lower sub-layer of the protective layer of the thermal head ranges from 4 μm to 10 μm.

12. The thermal recording system according to claim 1, wherein said lower sub-layer of the protective layer of the thermal head has a multi-layer structure formed of either similar or dissimilar materials.

13. The thermal recording system according to claim 1, wherein said thermal recording layer unit has a water content of no more than 5 wt. %.

14. The thermal recording system according to claim 13, wherein said thermal recording layer unit has a water content of no more than 4 wt. %.

* * * * *